US006933428B1

(12) United States Patent
Pedgley et al.

(10) Patent No.: US 6,933,428 B1
(45) Date of Patent: Aug. 23, 2005

(54) ACOUSTIC DEVICE

(76) Inventors: Owain Francis Pedgley, 259 Providence Road, Walkley Bank, Sheffleld, South Yorkshire (GB), S6 5BH; Robert James Armstrong, 52 Stratford Street, Coventry, Warwickshire (GB), CV2 4NJ; Edwin William Longley Norman, 16 Wightman Close, Shepshed, Leicester, Leicestershire (GB), LE12 9NQ ( * ) Notice: Subject to any disclaimer, the term of this patent is extended or adjusted under 35 U.S.C. 154(b) by 113 days.

(21) Appl. No.: 10/049,638

(22) PCT Filed: Aug. 9, 2000

(86) PCT No.: PCT/GB00/03073

§ 371 (c)(1),
(2), (4) Date: Apr. 1, 2002

(87) PCT Pub. No.: WO01/15135

PCT Pub. Date: Mar. 1, 2001

(30) Foreign Application Priority Data

Aug. 24, 1999 (GB) ..... 9919922

(51) Int. Cl.[7] ..... G10D 3/00
(52) U.S. Cl. ..... 84/291; 84/267
(58) Field of Search ..... 84/291, 290, 267, 84/274, DIG. 17

(56) References Cited

U.S. PATENT DOCUMENTS 4,185,534 A * 1/1980 Cove ..... 84/291
4,188,850 A 2/1980 Kaman, II
4,213,370 A 7/1980 Jones
4,290,336 A 9/1981 Peavey
4,334,452 A 6/1982 Morrison, III et al.
4,353,862 A 10/1982 Kaman, II
4,364,990 A 12/1982 Haines
4,391,177 A * 7/1983 Grajek et al. ..... 84/192
4,429,608 A 2/1984 Kaman et al.
4,873,907 A 10/1989 Decker, Jr. et al.
4,969,381 A 11/1990 Decker, Jr. et al.
5,103,709 A * 4/1992 Foss, Jr. ..... 84/327
5,441,997 A 8/1995 Walsh et al.
5,469,769 A 11/1995 Sawada et al.
5,602,355 A * 2/1997 Lipp ..... 84/422.4
5,804,746 A 9/1998 Kersenbrock et al.
5,847,332 A 12/1998 Faraone
6,345,726 B1 * 2/2002 Beeuwsaert ..... 220/359.3

FOREIGN PATENT DOCUMENTS

EP 0 604 079 6/1994
WO 95/21442 8/1995

OTHER PUBLICATIONS

Patent Abstract of Japan, vol. 1997, No. 08, Jul. 31, 1997 & JP 09 076332 A Mar. 25, 1997.

* cited by examiner

*Primary Examiner*—Kimberly Lockett
(74) *Attorney, Agent, or Firm*—Jacobson Holman PLLC

(57) ABSTRACT

Acoustic devices, particularly musical instruments, having a soundboard formed from expanded polycarbonate, methods of manufacture of same, and the use of specific soundboards in the manufacture of acoustic devices.

12 Claims, 3 Drawing Sheets

ACOUSTIC DEVICE

This is a nationalization of PCT/GB00/03073 filed Aug. 9, 2000 and published in English.

FIELD OF THE INVENTION

The present invention concerns acoustic devices, particularly musical instruments, having a new and improved soundboard, methods of manufacture of same, and the use of specific soundboards in the manufacture of acoustic devices.

BACKGROUND OF THE INVENTION

For a long time it has been desired to produce acoustic devices, particularly musical instruments such as guitars, using soundboards constructed from synthetic polymers rather than wood as is traditionally done. Such devices would be relatively simple and inexpensive to manufacture and the production of devices having reproducible acoustic properties would be reduced from the complex skill-dependent job of an artisan to a controllable manufacturing process.

There have been many attempts to produce musical instruments having synthetic polymer-based soundboards, e.g. U.S. Pat. No. 4,353,862, U.S. Pat. No. 4,364,990, U.S. Pat. No. 4,429,608, U.S. Pat. No. 4,969,381, U.S. Pat. No. 4,873,907, U.S. Pat. No. 4,188,850, U.S. Pat. No. 4,185,534, U.S. Pat. No. 4,213,370, U.S. Pat. No. 4,290,336, U.S. Pat. No. 4,334,452, U.S. Pat. No. 5,469,769, U.S. Pat. No. 5,804,746 and U.S. Pat. No. 4,290,336.

However, such instruments have typically suffered from the problem that they have been of a complex construction (for example with soundboards requiring carbon fibre or glass fibre reinforcements), are costly to manufacture, and have a sound quality not comparable to sound produced by instruments having the traditional wooden soundboard.

SUMMARY OF THE INVENTION

The present inventors have overcome the prior art disadvantages, producing musical instruments having polymer-based soundboards which are capable of producing sound of comparable quality to that produced by wooden soundboards. The materials used are readily available and may be used to produce any desired acoustic device having a soundboard.

According to the present invention there is provided an acoustic device having a soundboard comprising expanded polycarbonate.

The expanded polycarbonate may be provided in the form of a sheet.

The soundboard may have a cellular rigid foam structure.

The soundboard may have a density of 500–700 kg/m$^3$, for example 650 kg/m$^3$.

The soundboard may have a tensile strength of about 20 MPa.

The soundboard may have a flexural strength of about 30 N/mm$^2$.

One expanded polycarbonate material which is particularly useful is FOREX-EPC E 50.650 (Airex AG, Switzerland; SBA Ltd, Leicester, UK). It has a closed cell rigid foam structure, an apparent density (DIN 53479) of 650 kg/m$^3$, a tensile strength (DIN 53455) of 20 MPa, elongation at break (DIN 53455) of at least 10%, an E-Modulus in tension (DIN 53457) of 1000 MPa and in flexure (DIN 53457) of 1200 MPa, a flexural strength (DIN 53452) of 30 N/mm$^2$, is unbreakable on impact (DIN 53453), dimensional changes (DIN 16927) of ±0% at 120 minutes at 70° C., −0.5% at 75 minutes at 140° C. (MD) and +0.4% at 75 minutes at 140° C. (TD), and water absorption (DIN 53495) of less than 1% (W3—100° C. 30 minutes).

Although it has previously been suggested in the art to use foams in the construction of e.g. guitars, it has never been suggested to use expanded polycarbonates. For example, U.S. Pat. No. 4,185,534 suggests using polystyrene and other homopolymers and copolymers derived from hydrocarbon vinyl monomer. Accoustic tests conducted by the inventors using an expanded PVC (Foamex—Airex AG, Switzerland; SBA Ltd, Leicester, UK) were found to produce a very "dull" sound which was unacceptable. Non-expanded polystyrene was also tested and found to produce a very "tinny" sound which was also unacceptable.

In certain of the prior art, the use of foams is disclosed but this is typically in the manufacture of solid-bodied instruments and not hollow-bodied ones having a soundboard.

It is typically found with traditional wooden instruments having a soundboard that they have "dead spots" or emit "wolf tones", which are particular frequencies that either respond very poorly or are much louder than the notes of other frequencies. This problem can be mitigated or avoided completely using the soundboards of the present invention.

The expanded polycarbonates used in the acoustic devices of the present invention have excellent acoustic properties allowing for the construction of e.g. stringed instruments such as guitars (see below) which have a quality of sound at least as good as instruments having wooden soundboards.

Naturally the exact acoustic properties of expanded polycarbonates will vary with e.g. their apparent density, tensile strength and flexural strength. Other factors such as the size of bubbles in the foam, either open or closed cells, as well as the gas or gases contained in the foam are also important. Nitrogen is typically used to expand the polycarbonate into the foam structure, but other gases may equally be used. For example, halogens such as argon, neon and helium. Other normally gaseous (under normal atmospheric temperature and pressure) elements and compounds may also be used (subject to any undesired reactions with the polycarbonate) and will be readily apparent to one skilled in the art, for example as disclosed in e.g. U.S. Pat. No. 4,185,534.

As well as forming the soundingboard of the acoustic device out of an expanded polycarbonate such as a polycarbonate sheet, the physical characteristics of the expanded polycarbonate may vary from point to point. For example, if the acoustic device is a guitar, the expanded polycarbonate soundboard may vary in thickness across its width or along its length. Similarly the size and/or density of bubbles may be varied.

The acoustic device may be a guitar as discussed above, or it may be any other musical instrument, particularly a stringed musical instrument, having a soundboard. For example, it may be a violin, mandolin, bass, lute, dulcimer, harp or piano.

The acoustic device may equally be any other device having a soundboard, for example devices requiring sound resonance (amplification) such as loudspeakers, drums or alarm systems.

BRIEF DESCRIPTION OF THE DRAWINGS

The invention will be further apparent from the following description, with reference to the several figures of the accompanying drawings, which show, by way of example only, forms of guitar according to the present invention.

Of the Figures.

Figure 1:
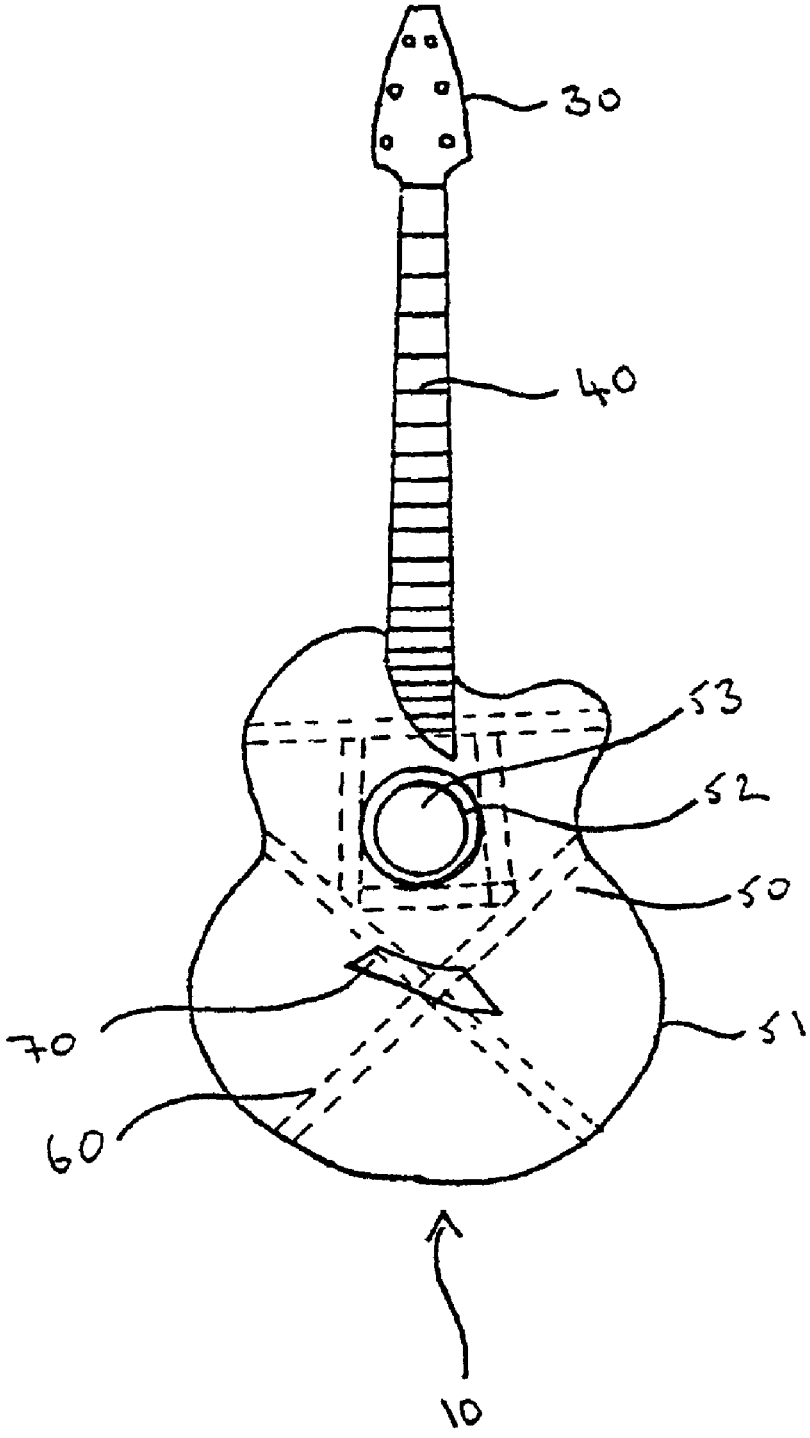
FIG. 1 shows a front view of a first embodiment of a guitar.

Guitar 10 incorporating a soundboard according to the present invention has a general construction as shown in British Registered Designs Nos. 2074916 (guitar body) and 2074917 (guitar bridge).

Guitar 10 comprises a wooden neck 20, head 30 and fretboard 40. Soundboard 50 comprises FOREX-EPC E 50.650 having outer edge 51 and inner edge 52 defining sound-hole 53. Underside bracing of soundboard 50 is provided by a clear Lexan-polycarbonate brace 60.

Bridge 70 comprises Lexan. Sides 80 and back 90 comprise a single piece epoxy glass fibre moulding. Soundboard 50, brace 60, bridge 70 and sides 80/back 90 and bonded together using methylmethacrylate adhesive.

In a first embodiment of guitar 10 provided in FIG. 1, a pattern construction for the main structural brace 60 is shown. Additional smaller braces (not shown) are used to distribute vibrations of the soundboard 50.

Figure 2:
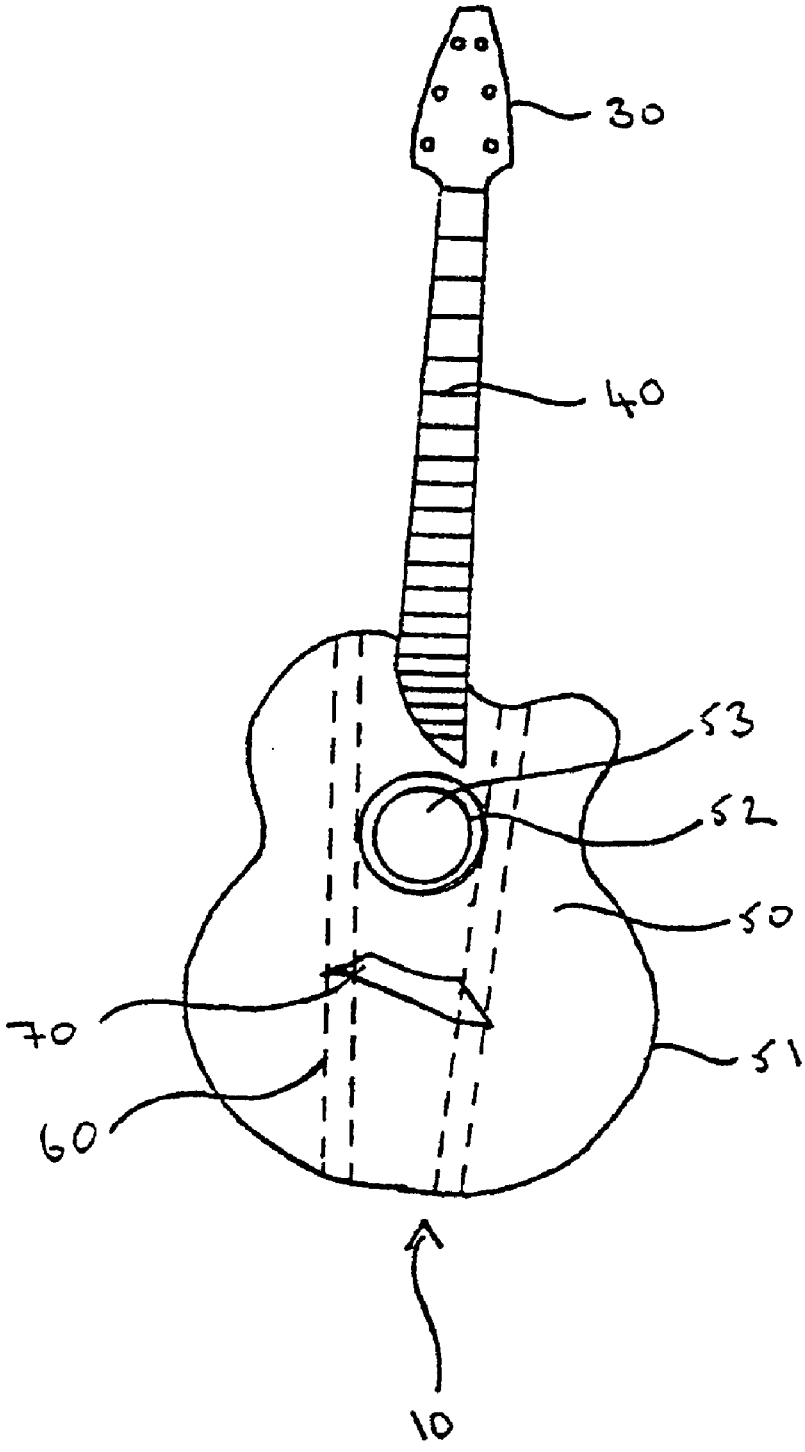
FIG. 2 shows a front view of a second embodiment of a guitar.
Figure 3:
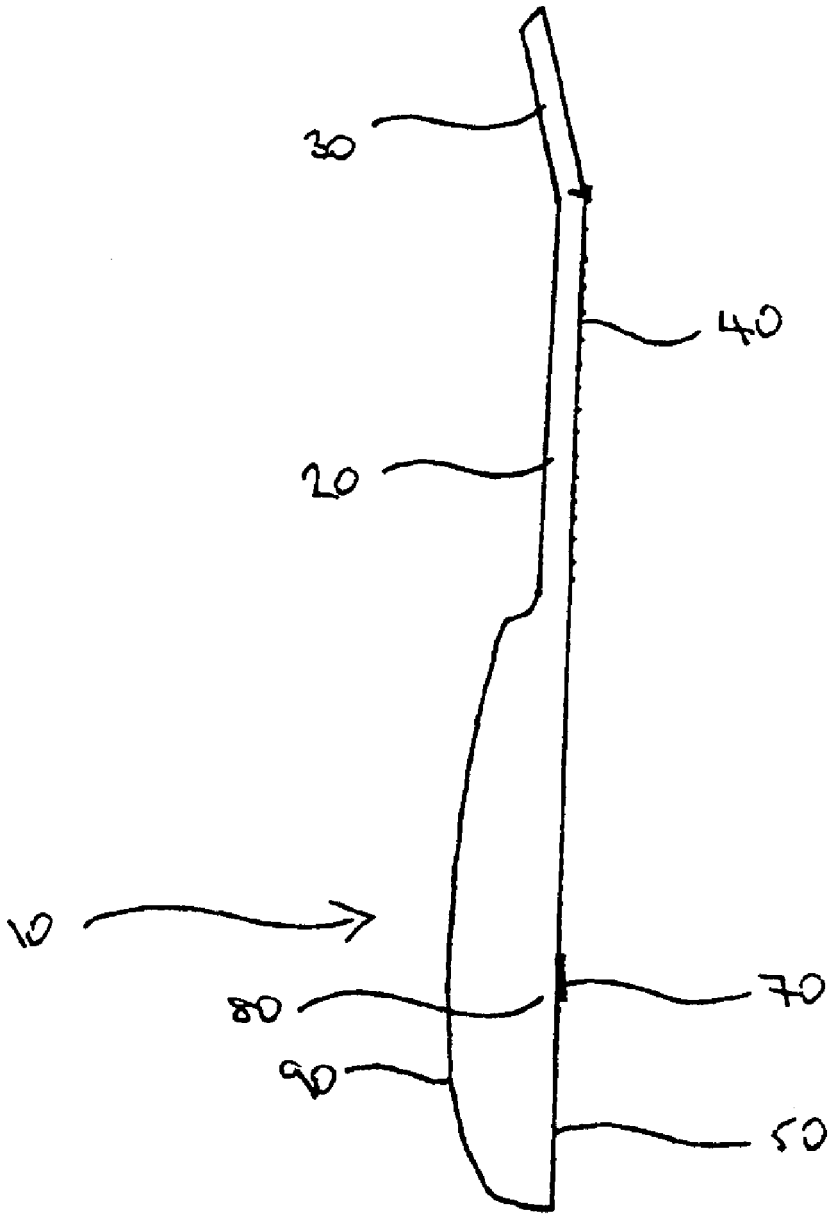
FIG. 3 shows a side view of the guitars in FIGS. 1 and 2.

A second embodiment of the guitar 10 is provided in FIG. 2. Here, brace 60 is in a slightly V-shaped pattern. The pattern of brace 60 according to this second embodiment may be more suited for production manufacture of guitar 10. In one variation (not shown) of the second embodiment, the pattern of brace 60 will be parallel rather than slightly V-shaped.

It will be appreciated that it is not intended to limit the invention to the above example only, many variations, such as might readily occur to one skilled in the art, being possible, without departing from the scope thereof as defined by the appended claims.

What is claimed is:

1. An acoustic device of a sound producer, said acoustic device comprising a body having a resonance chamber including a soundboard made of expanded polycarbonate having a foamed structure.

2. The acoustic device according to claim 1, wherein said soundboard comprises an expanded polycarbonate sheet.

3. The acoustic device according to claim 1, wherein said soundboard has a cellular rigid foam structure.

4. The acoustic device according to claim 1, wherein said soundboard has a tensile strength of about 20 Mpa.

5. The acoustic device according to claim 1, wherein the body is a musical instrument.

6. The acoustic device according to claim 5, wherein the body is a stringed musical instrument.

7. The acoustic device according to claim 6, wherein the body is a stringed musical instrument selected from the group comprising guitar, violin, mandolin, base, lute, dulcimer, harp and piano.

8. An acoustic device comprising a soundboard having a density of 500–700 $kg/m^3$ and made of expanded polycarbonate having a foamed structure.

9. The acoustic device according to claim 8, wherein said soundboard has a density of 650 $kg/m^3$.

10. An acoustic device comprising a soundboard having a tensile strength of about 20 Mpa and made of expanded polycarbonate having a foamed structure.

11. An acoustic device comprising a soundboard having a flexural strength of about 30 $N/mm^2$ and made of expanded polycarbonate having a foamed structure.

12. An acoustic device comprising a soundboard including a density of 650 $kg/m^3$, a tensile strength of about 20 Mpa, a flexural strength of about 30 $N/mm^2$ and made of expanded polycarbonate having a foamed structure.

* * * * *